US008687984B2

(12) United States Patent
Kamoshida et al.

(10) Patent No.: US 8,687,984 B2
(45) Date of Patent: Apr. 1, 2014

(54) IMAGE FORMING APPARATUS

(75) Inventors: Shigemi Kamoshida, Susono (JP); Takeshi Arimitsu, Odawara (JP); Atsushi Takasaka, Boise, ID (US); Yuuki Nakamura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 76 days.

(21) Appl. No.: 13/273,744

(22) Filed: Oct. 14, 2011

(65) Prior Publication Data

US 2012/0093523 A1 Apr. 19, 2012

(30) Foreign Application Priority Data

Oct. 15, 2010 (JP) ..... 2010-232848
Jun. 13, 2011 (JP) ..... 2011-131401

(51) Int. Cl.
*G03G 15/00* (2006.01)

(52) U.S. Cl.
USPC ..... 399/12; 399/111

(58) Field of Classification Search
USPC ..... 399/12, 111
See application file for complete search history.

(56) References Cited

U.S. PATENT DOCUMENTS 4,949,123 A * 8/1990 Takashima ..... 399/12
5,887,227 A 3/1999 Kawai et al.
6,535,709 B2 3/2003 Yokomori et al.
6,622,001 B2 9/2003 Arimitsu et al.
2003/0142991 A1* 7/2003 Arimitsu et al. ..... 399/90
2007/0160393 A1* 7/2007 Taguchi et al. ..... 399/258
2007/0264032 A1* 11/2007 Harumoto ..... 399/12
2010/0054797 A1 3/2010 Takeyama et al.
2011/0103835 A1 5/2011 Hayashi et al.

FOREIGN PATENT DOCUMENTS

JP 2003-084534 A 3/2003

* cited by examiner

*Primary Examiner* — Benjamin Schmitt
(74) *Attorney, Agent, or Firm* — Fitzpatrick, Cella, Harper & Scinto

(57) ABSTRACT

An image forming apparatus, to which a plurality of cartridges are detachably mountable, with the cartridges each having a cartridge side identification portion, includes an image forming unit configured to form an image, a plurality of mounting portions to which the cartridges are demountably mountable, and an identification urging mechanism provided in each of the mounting portions. The identification urging mechanism permits a cartridge to be mounted to the mounting portion when the cartridge is to be properly mounted to the mounting portion on the basis of correspondence with the cartridge side identification portion, and urges the cartridge in a direction opposite a direction in which the cartridge is mounted when the cartridge is improper for the mounting portion. The identification urging mechanism permits, even when the cartridge is improper for the mounting portion, the cartridge to enter to a mount position where the proper cartridge is mounted.

8 Claims, 15 Drawing Sheets

(a)

(b)

(a)

(b)

(a)

(b)

IMAGE FORMING APPARATUS

FIELD OF THE INVENTION AND RELATED ART

The present invention relates to an image forming apparatus such as a copy machine, a printer, a facsimile machine, and the like.

Among electrophotographic image forming apparatuses which employ two or more process cartridges which are necessary for image formation, some of them are of the so-called inline type. An electrostatic image forming apparatus of the inline type is structured so that multiple process cartridges are sequentially aligned, and also, so that each cartridge is mounted into its designated slot. In other words, an electrophotographic image forming apparatus of this type is structured so that it is impossible for its process cartridges to be mounted into the process cartridge slots other than their designated slot, one for one. Further, even an electrophotographic monochromatic image forming apparatus, that is, an electrophotographic image forming apparatus which employs only one process cartridge, is structured so that it is only a process cartridge which matches the type and specifications of the main assembly of the image forming apparatus that can be mounted in the process cartridge slot of the apparatus. That is, the image forming apparatus is structured so that only a process cartridge which matches in specification and type to the image forming apparatus can be mounted in its process cartridge; a process cartridge which is different in function from the cartridge designated thereto cannot be mounted in the process cartridge slot of the apparatus.

Thus, there have been proposed many structural designs for preventing a process cartridge from being mounted into a wrong process cartridge slot. For example, the process cartridge slots of an electrophotographic image forming apparatus are provided with a cartridge screening portion, for example, a recess or projection, and not only are the cartridge slots made different in the position and/or shape of the cartridge screening portion, but also, the position and/or shape of the cartridge screening portion are made to correspond to the color of the toner in a process cartridge (Japanese Laid-open Patent Application 2003-084534).

The conventional technologies such as the one described above suffer from the following problem: Process cartridges and the main assembly of an electrophotographic image forming apparatus have to be made sturdy enough not to deform or break even if a process cartridge is mounted into a wrong cartridge slot. Thus, the process cartridges and the main assembly of an electrophotographic image forming apparatus may have to be larger in size.

SUMMARY OF THE INVENTION

Thus, the primary object of the present invention is to provide an electrophotographic image forming apparatus, which not only makes it easier for a user to recognize that a cartridge was inserted into a wrong cartridge slot of the image forming apparatus, or the cartridge in a cartridge slot of the image forming apparatus is a wrong one, but also, can prevent, without requiring the apparatus to be increased in size, the problem that when a cartridge is inserted into a wrong cartridge slot, or a cartridge which is being inserted into a cartridge slot is a wrong one for the cartridge slot, the main assembly of the image forming apparatus and/or the cartridge is deformed or damaged.

According to an aspect of the present invention, there is provided an image forming apparatus to which a plurality of cartridges are detachably mountable, the cartridges each having a cartridge side identification portion, said image forming apparatus comprising a plurality of mounting portions to which said cartridges are demountably mountable; and an identification urging means, provided in each of said mounting portions, for permitting a cartridge to be mounted to said mounting portion when said cartridge is properly to be mounted to said mounting portion on the basis of correspondence with said cartridge side identification portion, and for urging said cartridge in a direction opposite a direction in which said cartridge is mounted when said cartridge is improper for said mounting portion.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 11(*b*) is a perspective view of two of the left cartridge guides 110 in the third embodiment, and shows the structure of the left cartridge guide 110.

DESCRIPTION OF THE PREFERRED EMBODIMENTS

Embodiment 1

Figure 1:
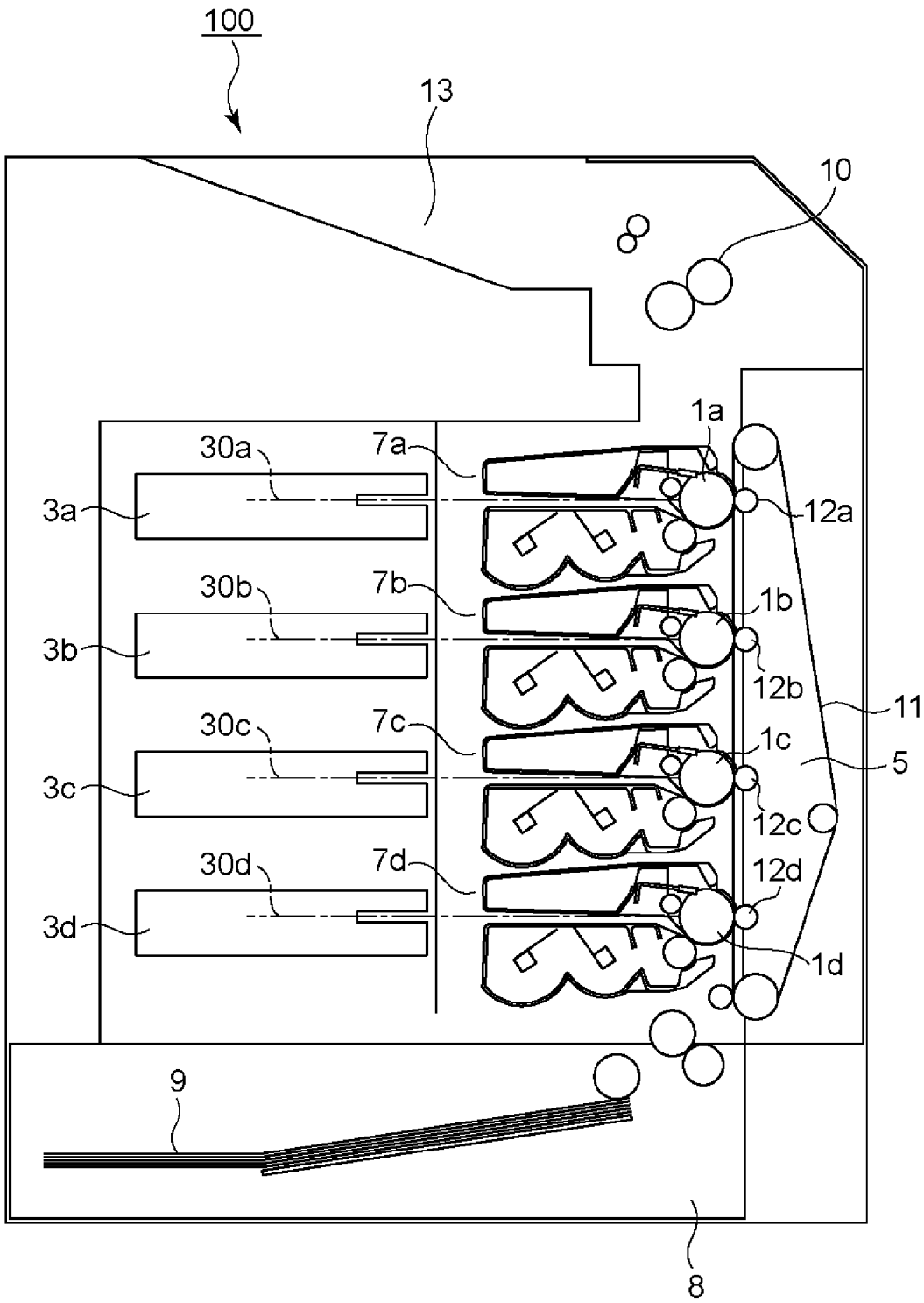
FIG. 1 is a schematic sectional view of the image forming apparatus in the first preferred embodiment of the present invention, and shows the general structure of the apparatus.

First, referring to FIG. 1, the first preferred embodiment of the image forming apparatus in accordance with the present invention is described. FIG. 1 is a schematic sectional view of the image forming apparatus in this embodiment, and shows the general structure of the apparatus. The image forming apparatus 100 has four photosensitive drums (1*a*-1*d*), as image bearing members, which are vertically aligned in tandem. The photosensitive drums 1 (1*a*-1*d*) are rotated by an unshown driving means. The image forming apparatus 100 has also an electrostatic transfer belt 11, which is circularly moved in contact with all the photosensitive drums 1.

Figure 2:
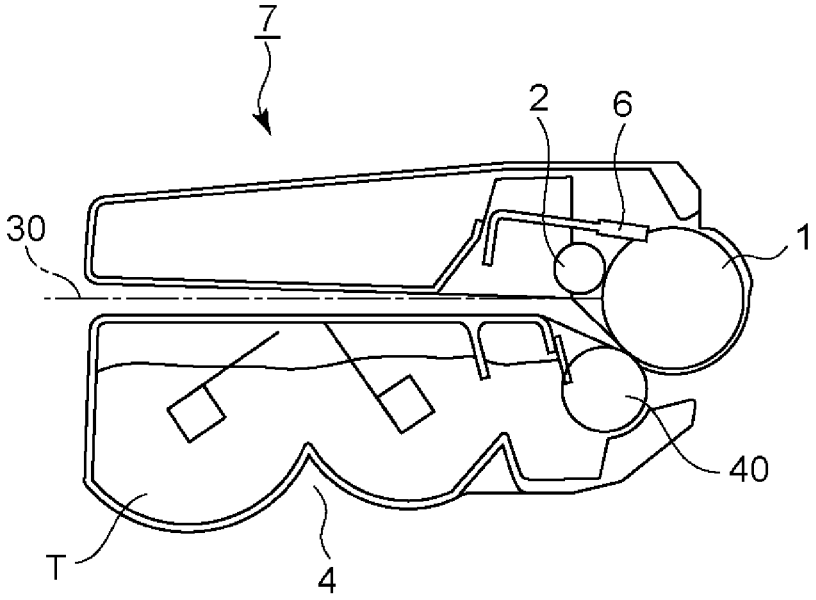
FIG. 2 is a schematic sectional view of the process cartridge in the first embodiment, and shows the general structure of the cartridge.

Next, referring to FIG. 2 along with FIG. 1, the apparatus 100 has four image forming stations. Each image forming station has a charge roller 2, a scanner unit 3 (3*a*, 3*b*, 3*c* or 3*d*), a development unit 4, an electrostatic transferring device 5, and a cleaning device 6, which are in the listed order in the adjacencies of the peripheral surface of the photosensitive drum 1. The photosensitive drum 1, charge roller 2, development unit 4, and cleaning device 6 are integrally placed in a cartridge, making up a process cartridge 7 (7*a*, 7*b*, 7*c* or 7*d*). Hereafter, each process cartridge 7 may be referred to simply as a cartridge 7.

Referring also to FIGS. 1 and 2, the cartridges 7 are sequentially driven with their image formation timing. As each cartridge 7 is driven, the photosensitive drum 1 (1*a*, 1*b*, 1*c* or 1*d*) in the cartridge 7 is rotated in the counterclockwise direction, and the corresponding scanner unit 3 (3*a*, 3*b*, 3*c* or 3*d*) is driven. As the cartridge 7 and scanner unit 3 are driven, the peripheral surface of the photosensitive drum 1 is uniformly charged by the charge roller 2, and the uniformly charged portion of the peripheral surface of the photosensitive drum 1 is scanned by a beam 30 (30*a*, 30*b*, 30*c* or 30*d*) of laser light projected by the scanner unit 30. As a result, an electrostatic latent image is formed on the uniformly charged portion of the peripheral surface of the photosensitive drum 1. Then, the latent image is developed by the development roller 40 in the development unit 4 into a toner image, that is, an image formed of toner.

Meanwhile, one of the sheets 9 of recording medium stored in layers in a sheet feeder cassette 8 is conveyed to the electrostatic transferring device 5, and is conveyed through the device 5, in synchronism with the progression of the sequential formation of the toner images, while a preset voltage is applied to the transfer roller 12 (12*a*, 12*b*, 12*c* or 12*d*). As a result, the toner image on the photosensitive drum 1 (1*a*, 1*b*, 1*c* or 1*d*) is transferred onto the sheet 9 of recording medium. Since the four image forming stations are sequentially operated, the four toner images, different in color, are sequentially transferred in layers onto the sheet P. After the transfer of the four toner images, different in color, onto the sheet 9, the sheet 9 is conveyed to a fixing device 10, and is conveyed through the fixing device 10, while being subjected to the heat and pressure applied thereto by the fixing device 10. As a result, the toner images on the sheet 9 are fixed to the sheet 9. Then, the sheet 9 is discharged into a delivery tray 13, which is an integral part of the top wall of the image forming apparatus 100.

[Cartridge Installation into Apparatus Main Assembly, and Cartridge Removal from Apparatus Main Assembly]

Figure 3:
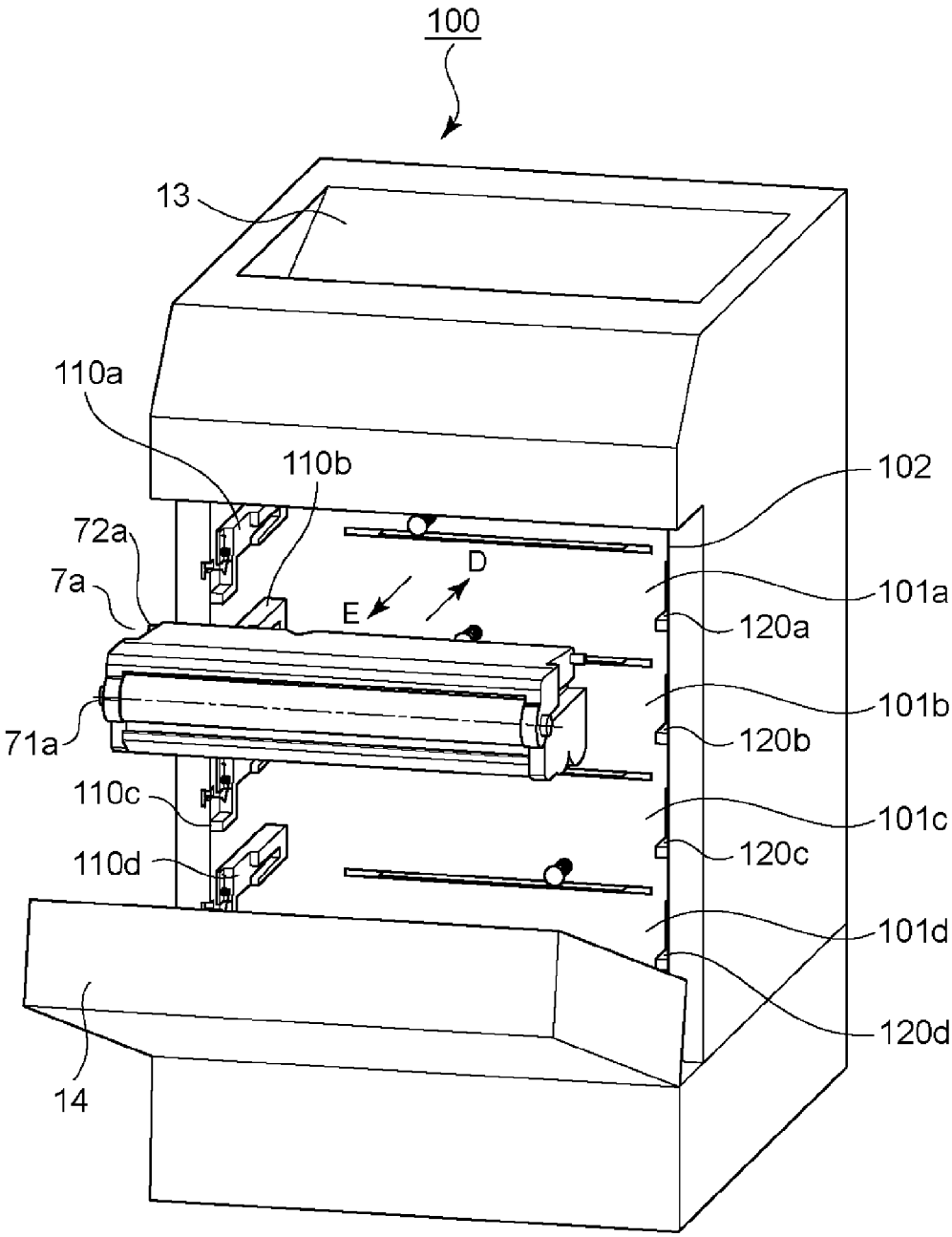
FIG. 3 is a perspective view of a combination of the image forming apparatus in the first embodiment and one of the process cartridges therefor, and shows how the process cartridge is mounted into, or removed from, the main assembly of the image forming apparatus.

Referring to FIG. 3, the image forming apparatus 100 has multiple (four) cartridge slots 101 (101*a*-101*d*) in which the multiple (four) cartridges 7 are removably installable. In consideration of the service life of each component (photosensitive drum 1, charge roller 2, development roller 40, etc.) in the cartridge 7, which is directly related to an image formation process; the service life of the toner in the cartridge 7, also, the service life of the toner in the cartridge 7, which also is directly related to an image formation process; and the amount of toner usage, each cartridge 7 is replaced with a brand-new one as the cumulative length of its usage reaches a preset value, or cumulative number of images formed with the use of the cartridge 7 reaches a preset value. As for the method for replacing the cartridge 7, first, the front cover 14 of the image forming apparatus 100 is to be opened, and then, the cartridge which needs to be replaced is to be pulled out of its slot 101 (101*a*, 101*b*, 101*c* or 101*d*) of the image forming apparatus 100. Then, a brand-new cartridge 7, which matches the removed cartridge 7, is to be inserted into the vacated cartridge slot 101, in such an attitude that the photosensitive drum 1 in the cartridge 7 will be on the front side of the main assembly of the apparatus 100, in the direction (indicated by arrow mark E) perpendicular to the front wall of the main assembly.

The image forming apparatus 100 has an opening 102 through which the cartridges 7 (7*a*-7*d*) are installed into, or removed from, the apparatus 100. It has also left guides 110 (110*a*-110*d*) and right guides 120 (120*a*-120*d*), which are for guiding cartridges 7 (7*a*, 7*b*, 7*c* and 7*d*) into the cartridge slots 101 (101*a*, 101*b*, 101*c* and 101*d*), respectively, in the image forming apparatus 100. The left and right guides 110 and 120 are on the left and right ends of the opening 102, one for one.

Figure 4:
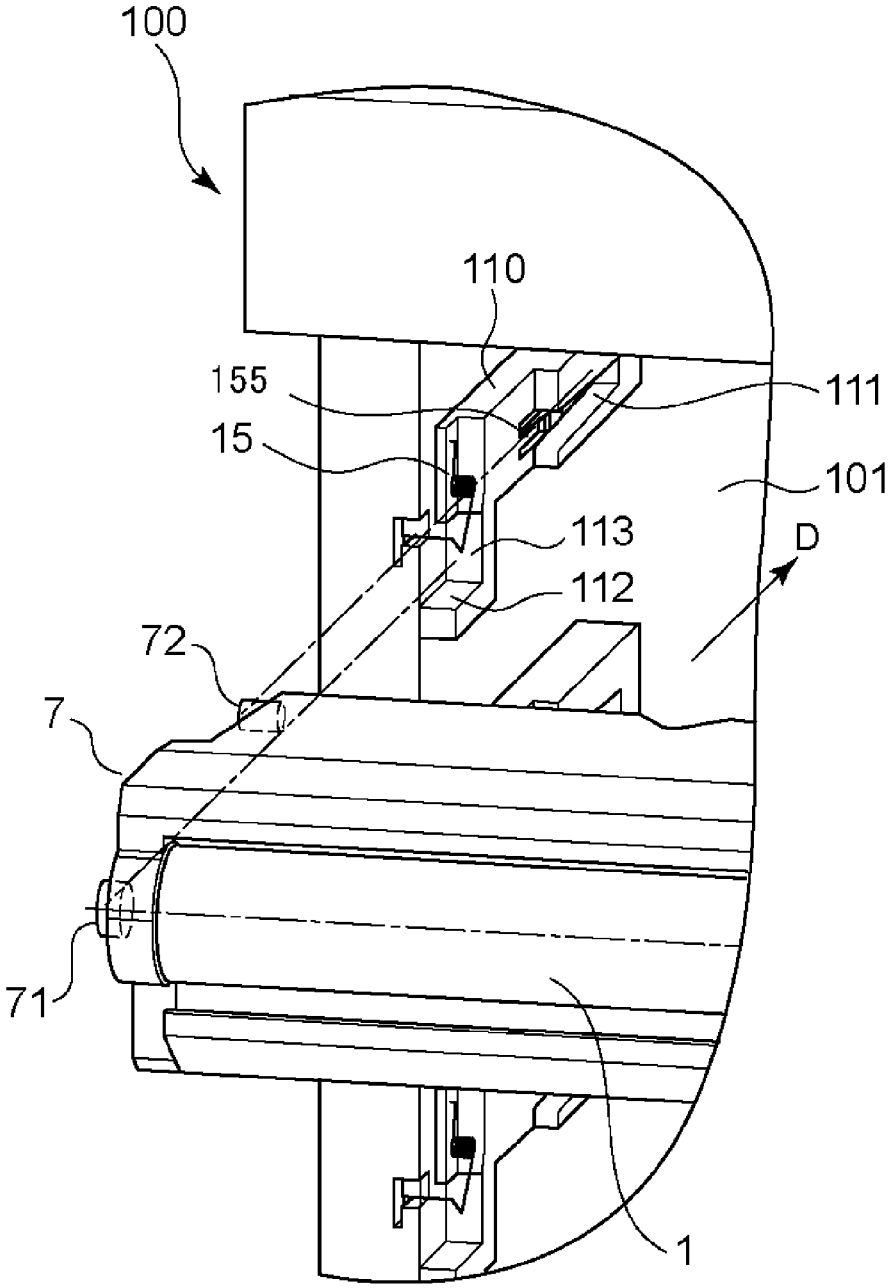
FIG. 4 is a partial perspective view of a combination of one of the process cartridge slots of the image forming apparatus in the first embodiment, and the corresponding process cartridge, and shows how the cartridge is mounted into the cartridge slot.

Next, referring to FIG. 4, each cartridge 7 is provided with a cartridge positioning projection 71 and a boss 72, which project outward from the lengthwise end surfaces of the cartridge 7, one for one. The axial line of the projection 71 coincides with the axial line of the photosensitive drum 1. The projection 71 is for precisely positioning the cartridge 7 relative to the image forming apparatus 100. The boss 72 is at the leading end of the cartridge 7 in terms of the direction in which the cartridge 7 is inserted into the image forming apparatus 100. It is for properly positioning the cartridge relative to the image forming apparatus 100 in terms of its attitude. When it is necessary to install any of the cartridges 7 into the corresponding cartridge slot 101, the cartridge 7 is to be inserted so that the boss 72 fits into the groove 111 of the left guide 110, and then, the projection 71 rides onto the cartridge positioning surface 112 of the left guide 110. Next, referring to FIGS. 4 and 15(*a*), each cartridge slot 101 is provided with a projection 115 for preventing the problem that in a case where a cartridge 7 is inserted into a wrong cartridge slot 101, it falls out of the cartridge slot 101 as soon as an installer releases the cartridge 7. The projection 115 is flexible, and is at the front end of the groove 111. Thus, as a cartridge 7 is inserted into the corresponding cartridge slot 101 in the direction indicated by an arrow mark D, the boss 72 comes into contact with the slanted surface 155*a* of the cartridge position controlling portion 155, which is on the entrance side of the projection cartridge screening member 16. Then, as the cartridge 7 is inserted deeper, the projection cartridge screening member 16 is flexed by the boss 72 in the direction indicated by an arrow mark S, that is, the direction to give away to the boss 72 (FIG. 15(*b*)), allowing thereby the boss 72 to ride over the projection cartridge screening member 16 and enter the groove 111 (FIG. 15(*c*)). Then, as the cartridge 7 is inserted all the way into the cartridge slot 101, the projection 71 is pressed upon the cartridge positioning surfaces 112 and 113 of the left guide 110, by a torsional coil spring 15 with which the main assembly of the image forming apparatus 100 is provided. As a result, the cartridge 7 is properly positioned relative to the image forming apparatus 100.

Figure 5:
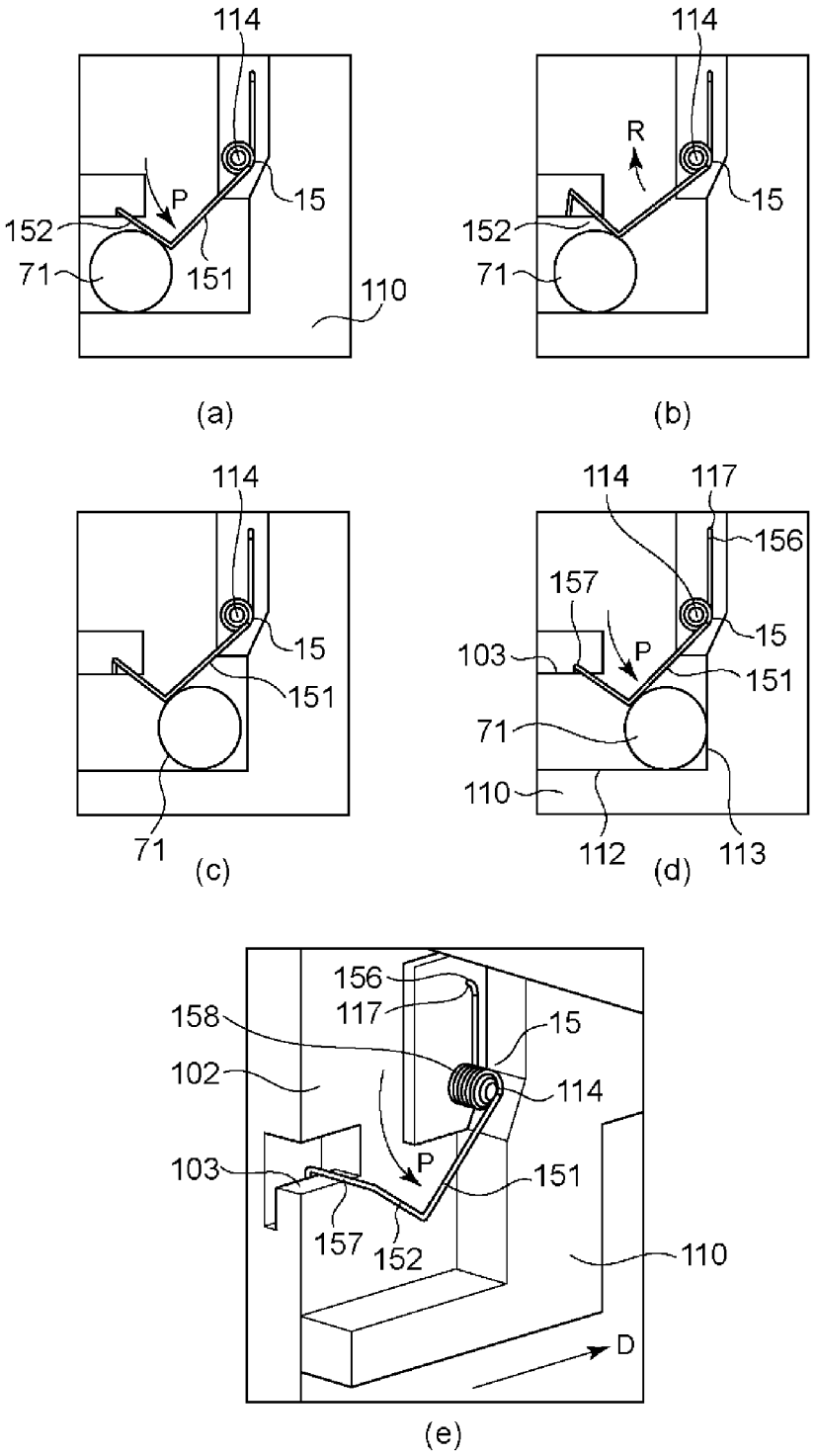
FIG. 5 is a drawing for describing the changes which occur to the positional relationship between the cartridge positioning projection of a cartridge and the cartridge positioning torsional coil spring of the cartridge slot of the image forming apparatus, and the changes which occur to the shape of the torsional coil spring, in the first embodiment.

Next, referring to FIG. 5(*e*), the torsional coil spring 15 is rotationally fitted around the boss 114 with which the left guide 110 is provided. The anchorage end 156 of the torsional coil spring 15 is fitted in a hole 117 of the left guide 110, being thereby immovably attached to the left guide 110. When the spring 15 is fitted around the boss 114, it is torqued in such a direction that as it is pressed by the boss 72 as described above, it presses the cartridge positioning projection 71 toward the cartridge positioning surfaces 112 and 113 (moment generated by spring 15 works in direction indicated by arrow mark P). The other end 157 of the spring 15 is loosely fitted in a groove 103 with which the cartridge slot 101 is provided. Thus, it is prevented from rotationally moving in the direction indicated by the arrow mark P. The spring 15 is shaped so that its portion between its coiled portion 158 and its lengthwise end 157 (loosely fitted in groove 103) is bent by roughly 90 degrees, and the portion between the point of bend and the coiled portion 158 functions as the portion 151 for pressing the cartridge positioning projection 71, and the portion between the lengthwise end 157 and the point of bend functions as the portion 152 by which the lengthwise end 157 is pushed upward.

Referring to FIG. 5(*a*), as a cartridge 7 is inserted into its correct cartridge slot in the image forming apparatus 100, first, the projection 71 comes into contact with the portion 152 of the spring 15, by which the spring 15 is pushed upward. Next, referring to FIG. 5(*b*), as the cartridge 7 is inserted further, the projection 71 pushes up the portion 152 of the spring 15 in the direction indicated by an arrow mark R, against the resiliency of the spring 15. Then, as the cartridge 7 is inserted into the cartridge slot even further, the projection 71 moves past the point of bend of the spring 15, and comes into contact with the cartridge positioning (pressing) portion 151 of the spring 15, being thereby properly positioned relative to the image forming apparatus 100, as shown in FIG. 5(*c*). As the projection 71 comes into contact with the surfaces 112 and 113 and is pressed upon the surfaces 112 and 113 by the cartridge positioning portion 151 of the spring 15 in the direction (indicated by arrow mark P), the cartridge 7 is properly positioned for image formation, in the cartridge slot 101. The shape of the lengthwise end 157 of the spring 15, and the shape of the groove 103, are such that when the projection 71 is in contact with the surfaces 112 and 113, there is a certain amount of gap between the lengthwise end portion 157 of the spring 15 and the corresponding surface of the groove 103, as shown in FIG. 5(*d*). Therefore, the cartridge positioning portion 151 of the spring 15 can keep the projection 71 in contact with the surfaces 112 and 113, whereby the cartridge 7 can be kept properly positioned for image formation, in the cartridge slot 101.

[Means for Preventing Cartridge Installation Errors]

Figure 6:
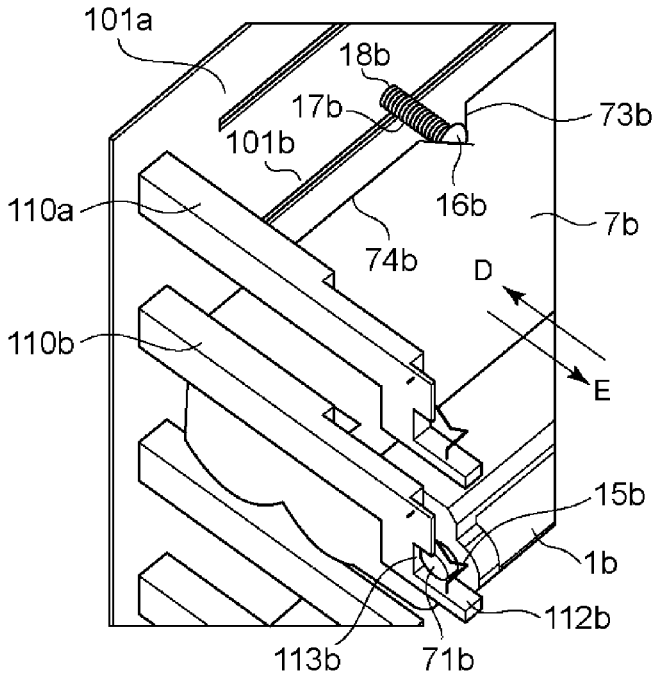
FIG. 6 is a perspective view of the process cartridge installation error preventing means, and its adjacencies, of the image forming apparatus in the first embodiment. It is for showing the structure and working of the means.
Figure 6:
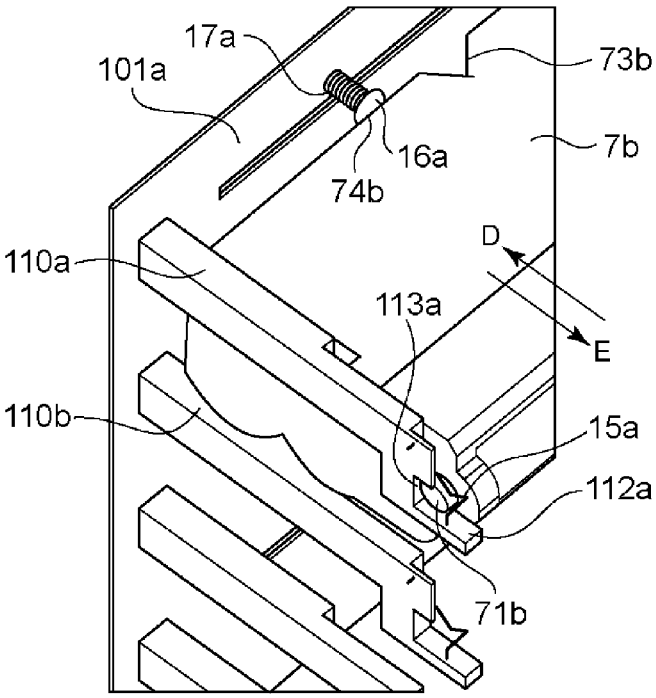

Referring to FIG. 6, each of the cartridges 7 (7*a*-7*d*) has an identification recess (cartridge identification portion of cartridge) 73 (73*a*-73*d*). The identification recess 73 is at the leading end of the cartridge 7, in terms of the cartridge installation direction (indicated by arrow mark D). The shape and/or position of the identification recess 73 corresponds to the color of the toner in a cartridge 7. That is, the identification recess 73 for a cartridge 7 which contains yellow toner, for example, is different in shape from those for cartridges 7 which contain other toners than yellow toner. More specifically, in this embodiment, the four process cartridges 7*a*, 7*b*, 7*c*, and 7*d* are made different in the position of the identification recess 73, in terms of the direction parallel to the front (rear) wall of the main assembly of the image forming apparatus 100, so that each cartridge 7 can be identified, in terms of toner color, based on the positioned of its identification recess 73.

As for the cartridge slots 101 (101*a*-101*d*) of the image forming apparatus 100, they are provided with cartridge screening members 16 (16*a*-16*d*), one for one, which are different in position in terms of the direction parallel to the front (or rear) wall of the main assembly of the image forming apparatus 100, and the position of which corresponds to the color of the toner in the cartridge 7. The cartridge screening member 16 is attached to the rear wall 18 (18*a*, 18*b*, 18*c*, or 18*d*) of the cartridge slot 101. It is fitted with a compression spring 17 (17*a*, 17*b*, 17*c* or 17*d*), which keeps the cartridge screening member 16 pressed in the opposite direction (indicated by arrow mark E) from the cartridge installation direction.

Next, referring to FIG. 6(*a*), as the cartridge 7*b*, for example, is inserted all the way into the cartridge slot 101*b*, that is, the correct cartridge slot for the cartridge 7*b*, the cartridge screening member 16*b* fits into the identification recess 73*b*, and therefore, the compression spring 17*b* is not compressed. At the same time, the torsional coil spring 15*b* presses the cartridge positioning projection 71*b* on the cartridge positioning surfaces 112*b* and 113*b*, ending the installation of the cartridge 7*b*.

Figure 15:
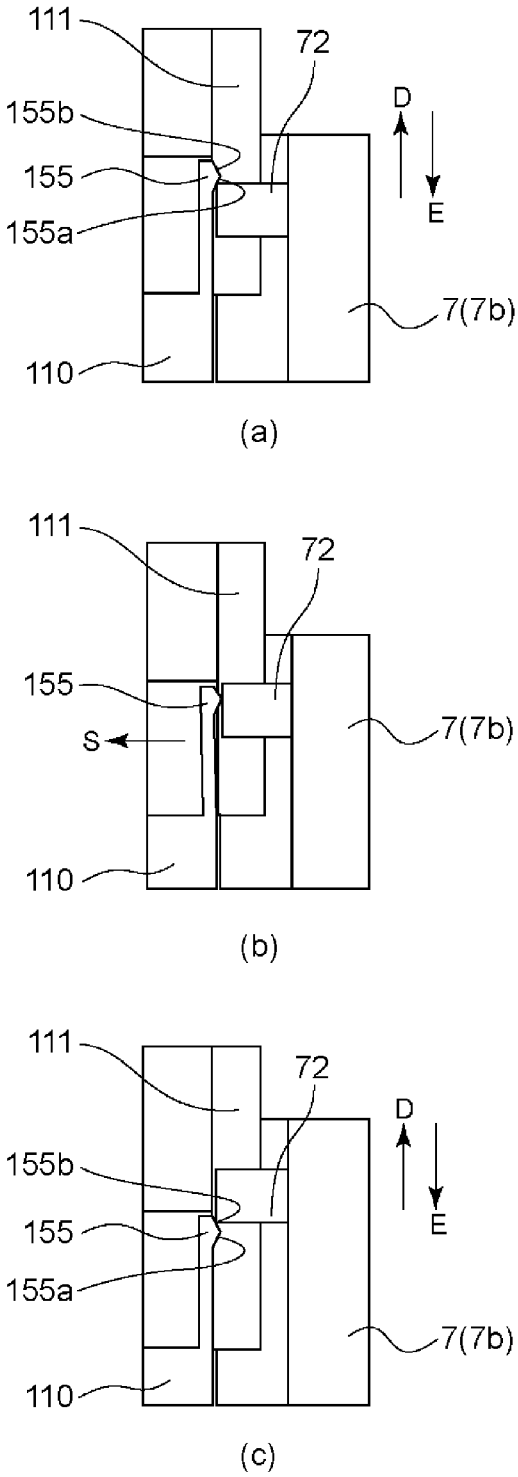
FIGS. 15(*a*), 15(*b*) and 15(*c*) are sectional views of a combination of the left cartridge guide of one of the cartridge slots of the image forming apparatus, and the left end of the cartridge therein, in the first preferred embodiment of the present invention, at a plane which is parallel to the bottom or top wall of the image forming apparatus. They describe the changes which occur to the relationship between the cartridge positioning projection of a cartridge, and the cartridge position controlling portion 155 of the left guide of one of the cartridge slots of the image forming apparatus, when the cartridge is inserted into, or removed from, the cartridge slot, in the first preferred embodiment.

However, if the cartridge 7*b* is inserted into the cartridge slot 101*a*, that is, one of the wrong slots for the cartridge 7*b*, as shown in FIG. 6(*b*), the cartridge screening member 16*a* does not coincide in position to the identification recess 7*b*. Thus, the cartridge screening projection 16*a* comes into contact with the front surface 74*b* of the cartridge 7*b* in terms of the cartridge insertion direction. Thus, as the cartridge 7*b* is pushed further inward, the cartridge 7*b* moves all the way into the cartridge slot 101*a* while pressing the cartridge screening projection 16*a* by the leading end (surface 74*b*) against the resiliency of the torsional coil spring 17*a*, until the cartridge positioning projection 71*b* is pressed on the cartridge positioning surfaces 112*a* and 113*a* by the torsional coil spring 15*a*. Regarding the relationship between the amount of force which the resiliency of the compression spring 17*a* generates in the upstream direction (indicated by arrow mark E), in terms of the cartridge insertion direction, and the amount of force which the spring 15*a* generates in the downstream direction (indicated by arrow mark D) in terms of the cartridge insertion direction, the image forming apparatus 100 is designed so that the former overwhelms the latter. Thus, if a user releases the cartridge 7*b* after the user pushed the cartridge 7*b* all the way into the cartridge slot 7*a*, the cartridge 7*b* is pushed back in the direction of the arrow mark E by the resiliency of the compression spring 17*a* against the resiliency of the spring 15*a*. As the cartridge 7*b* is pushed back, the boss 72*a* comes into contact with the cartridge blocking surface cartridge blocking surface 155*a* of the cartridge position controlling portion 155, being thereby prevented from moving further in the direction indicated by the arrow mark E, as shown in FIG. 15(*c*). In other words, the cartridge 7*b* is prevented from falling out of the main assembly of the image forming apparatus 100. At this point, the cartridge 7*b* is still under the pressure applied to the cartridge 7*b* by the compression spring 17*a* in the direction of the arrow mark E, but, the amount of pressure applied to the cartridge 7*b* by the compression spring 17*a* at this point of the action of the cartridge 7*b* is not large enough to force the cartridge position controlling portion 155 to deform in the direction indicated by the arrow mark S. Thus, if a user wants to take the cartridge 7*b* out of the cartridge slot 101*a* at this point, the user has to move the cartridge 7*b* further in the direction of the arrow mark E. As the user moves the cartridge 7*b* further in the direction of the arrow mark E, the boss 72 presses on the surface 155*b*, causing thereby the cartridge position controlling portion 155 to elastically bend (direction of arrow mark S in FIG. 15(*b*)). Thus, the boss 72 is allowed to ride over the portion 155 to come out of the groove 111 (FIG. 15(*a*)). Incidentally, if it is desired to ensure that the cartridge 7*b* is prevented from accidentally falling out of the main assembly of the image forming apparatus 100, the surface 155*a* may be made greater in angle than the surface 155*b*, provided that the increase in the angle of the surface 155*a* does not become problematic in terms of the extraction of the cartridge 7*b* from the cartridge slot 101*a*.

In the case of this embodiment of the present invention, even if a cartridge 7 (7*a*, 7*b*, 7*c* or 7*d*) is inserted into a wrong cartridge slot 101 (101*a*, 101*b*, 101*c* or 101*d*), that is, the cartridge slot 101 which is not for the cartridge 7, it is allowed to advance all the way into the wrong cartridge slot 101 as shown in FIG. 6(*a*). Therefore, it is unlikely for a user to apply an excessive amount of force to the cartridge 7 when installing the cartridge 7. Further, as the user releases the cartridge 7 (7*a*, 7*b*, 7*c* or 7*d*) after the user inserted the cartridge 7 all the way into the wrong cartridge slot 101, the cartridge 7 is pushed back by the resiliency of the compression spring 17 (17*a*, 17*b*, 17*c* or 17*d*) in the direction of the arrow mark E. Thus, it is easy for the user to recognize the installation error. Moreover, as the cartridge 7 is pushed back by the spring 17, it is prevented by the cartridge position controlling portion 155 from falling out of the main assembly of the image forming apparatus 100. In other words, the present invention can prevent the cartridge damages attributable to the problem that when a cartridge 7 is inserted into a wrong cartridge slot of an image forming apparatus, it falls out of the main assembly. Further, the components for preventing the aforementioned installation error are elastic. Therefore, even if a user forces a cartridge 7 into a wrong cartridge slot of an image forming apparatus, the cartridge and/or the main assembly of the image forming apparatus are unlikely to be damaged.

Figure 7:
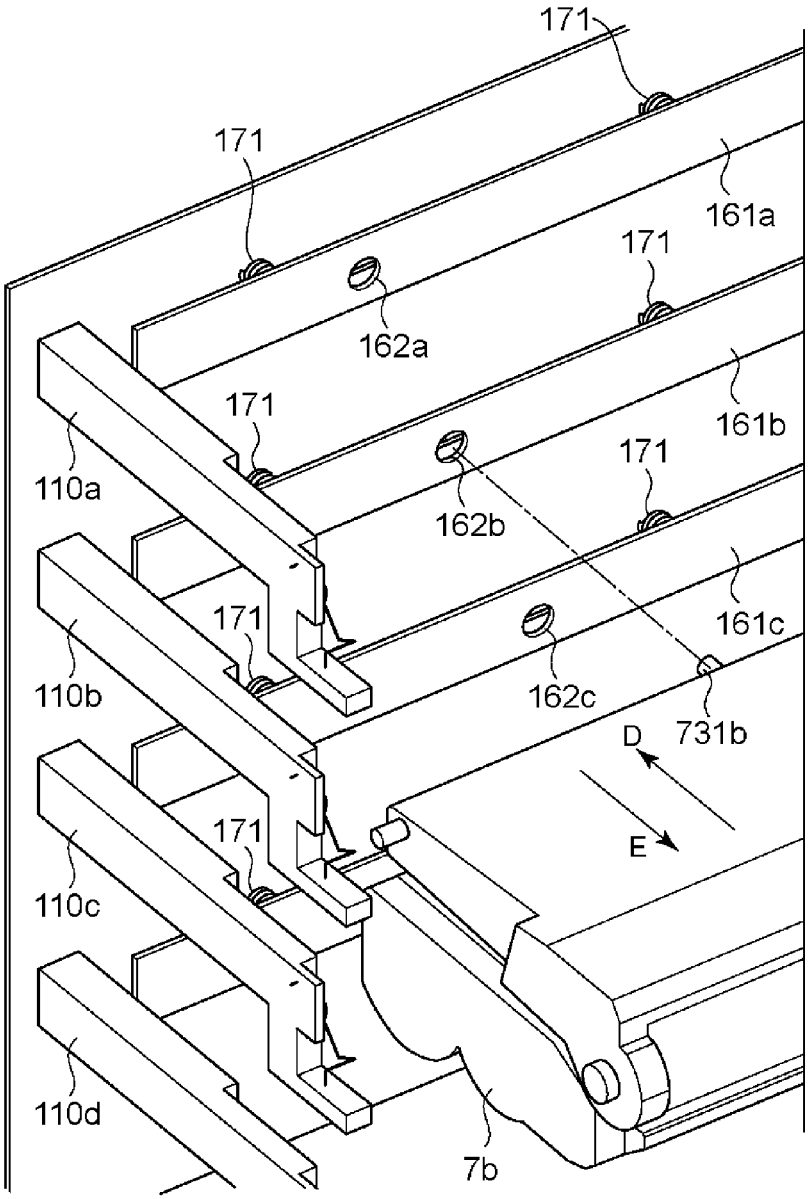
FIG. 7 also is a perspective view of the process cartridge installation error preventing means, and its adjacencies, of the image forming apparatus in the first embodiment. It is for showing the structure and working of the means.

In this embodiment, the cartridge identification recess 73 as a cartridge identification marker was at the leading end of each cartridge 7 in terms of the cartridge insertion direction indicated by the arrow mark D. However, a cartridge identification marker may be in the form of a projection 731 as shown in FIG. 7. In a case where a projection 731 (731*a*, 731*b*, 731*c* or 731*d*) as a cartridge identification marker is attached to a cartridge 7, each cartridge slot of an image forming apparatus is provided with a cartridge screening plate 161 (161*a*, 161*b*, 161*c* or 161*d*). More specifically, the cartridge screening plate 161 is provided with a through hole 162 (162*a*, 162*b*, 162*c* or 162*d*), which corresponds in position to the cartridge identification projection 731 in terms of the direction parallel to the front wall of the image forming apparatus 100. Further, the cartridge screening plate 161 is attached to a pair of compression springs 171 (screening plate supporting/pressing means), which are attached to the rear wall of the cartridge slot 101. Thus, when a given cartridge 7 is inserted into the correct cartridge slot for the given cartridge, its identification projection 731 enters the through hole 162, and therefore, the compression springs 171 are not compressed. Further, as soon as the cartridge 7 is inserted all the way into the cartridge slot, the torsional coil spring 15 presses the cartridge positioning projection 71 on the cartridge positioning surfaces 112 and 113, ending thereby the cartridge installation. On the other hand, if a given cartridge 7 is inserted all the way into a cartridge slot which is incorrect for the given cartridge 7, the identification projection 731 comes into contact with the screening plate 161. Thus, the compression springs 171 are compressed. Then, as a user releases the cartridge 7, the cartridge 7 is pushed back in the direction indicated by the arrow mark E by the resiliency of the compression springs 171 against the resiliency of the spring 15.

Incidentally, not only is this means for preventing installation error employable by an electrophotographic image forming apparatus of the inline type, such as the one in this embodiment, but also, an electrophotographic monochromatic image forming apparatus, an electrophotographic color image forming apparatus of the rotary type, and the like, to find out whether or not a given cartridge is different in type or specification from a cartridge for a given electrophotographic image forming apparatus. In a case where this installation error preventing means is employed by an electrophotographic color image forming apparatus such as the one in this embodiment, the following effects which are specific to this type of image forming apparatus are obtained. That is, if one of the process cartridges for an electrophotographic image forming apparatus of the inline type, in which multiple process cartridges are positioned in tandem, is installed in a wrong cartridge slot of the apparatus, this cartridge protrudes a little compared to the cartridges in their correct slots as soon as the installer release the cartridge. Therefore, even if the amount by which a cartridge is made to protrude by its installation into a wrong cartridge slot is small, the installation error can be easily recognized.

Further, in this embodiment, the means for preventing the process cartridge installation error is used for preventing a process cartridge having a photosensitive drum from being installed in a wrong cartridge slot. However, this embodiment is not intended to limit the application of the present invention to a process cartridge having a photosensitive drum. That is, the present invention can also be applied to a developing device cartridge, a developer supply cartridge, and the like. In other words, the present invention is applicable to any cartridge or the like which is to be removably installed in the image assembly of an apparatus by a user.

Embodiment 2

Figure 9:
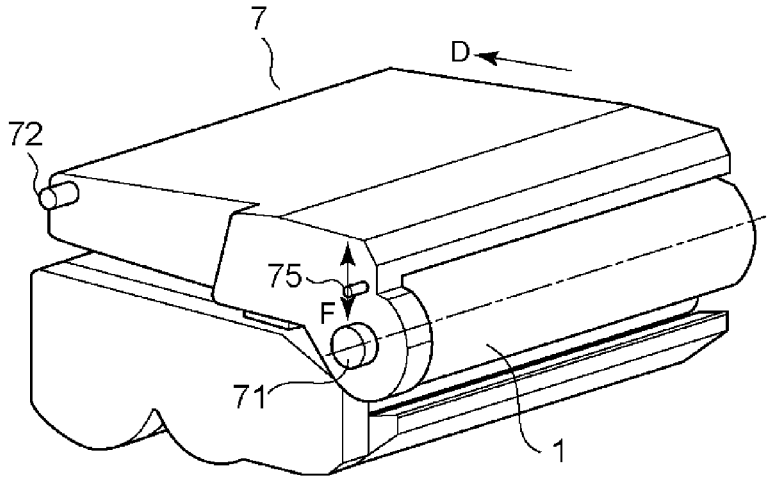
FIG. 9 is a perspective view of the combination of one of the process cartridges, and the lengthwise ends of a couple of the process cartridge slots of the image forming apparatus in the second embodiment, and shows the structure of the combination.
Figure 9:
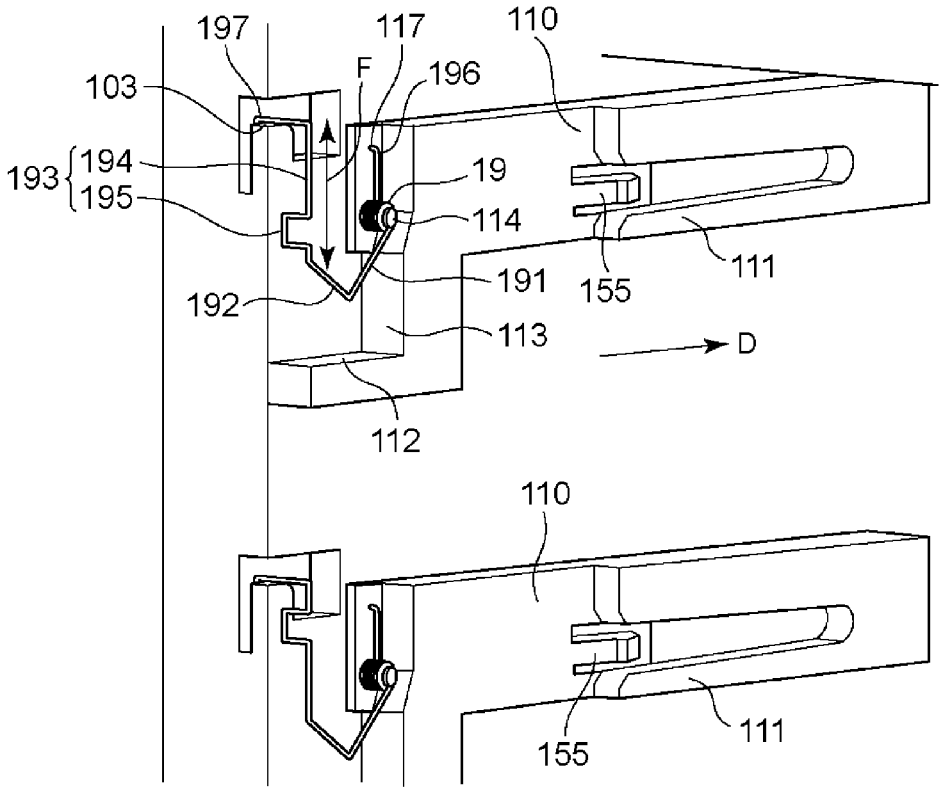

Next, the image forming apparatus in the second preferred embodiment of the present invention is described with reference to the appended drawings. The components, portions, etc., of the image forming apparatus in this embodiment, which are the same in description as the counterparts in the first embodiment, are given the same referential codes as those given to the counterparts, and are not going to be described here. FIG. 9(*a*) is a perspective view of the process cartridge in the second embodiment. FIG. 9(*b*) is a perspective view of two of the left cartridge guides 110 in the second embodiment.

Referring to FIG. 9(*a*), the left cartridge guide 110 in this embodiment is provided with a combination of an identification projection 75 (cartridge identifying means on cartridge side) and a torsional coil spring 19, instead of the combination of the identification recess 73 and torsional spring 15 in the firsts embodiment.

The cartridges 7*a*, 7*b*, 7*c*, and 7*d* are made different (specific) in the position of their identification projection 75 in terms of the direction indicated by an arrow mark F, which is roughly perpendicular to both the direction indicated by an arrow mark D and the axial line of the photosensitive drum 1, so that they can be identified in terms of the color of the toner they contain.

Next, referring to FIG. 9(*b*), like the torsional coil spring 15 in the first embodiment, the torsional coil spring 19 also has a cartridge positioning portion 191, a cartridge catching portion 192 (by which spring 19 is pushed upward by cartridge positioning projection), an anchorage portion 196, and a semi-free end portion 197 (loosely fitted in groove 103). Further, the four torsional coil springs 19 are provided with a cartridge screening portion 193 (cartridge screening/pressure applying means), and are different in the position of the cartridge screening slot portion 195 of the cartridge screening portion 193. The cartridge screening portion 193 is the portion of the torsional coil spring 19, which is between the cartridge catching portion 192 and semi-free portion 197. It prevents a cartridge slot from accepting a wrong cartridge. The cartridge screening portion 193 has a cartridge contacting portion 194 and the U-shaped cartridge screening slot 195 (cartridge identification projection acceptance slot). The four torsional coil springs 19*a*, 19*b*, 19*c*, and 19*d* are made different in the position of the U-shaped cartridge screening portion 195 so that the U-shaped portion 195 does not interfere with the cartridge identification projection 75 of a given cartridge only when the given cartridge is the right one. That is, if the cartridge 7 inserted into a given cartridge slot is a wrong one, the cartridge identification projection 75 of the cartridge 7 comes into contact with the cartridge blocking portion 194 of the torsional coil spring 19. Thus, the cartridge 7 is prevented from entering further into the cartridge slot.

Figure 10:
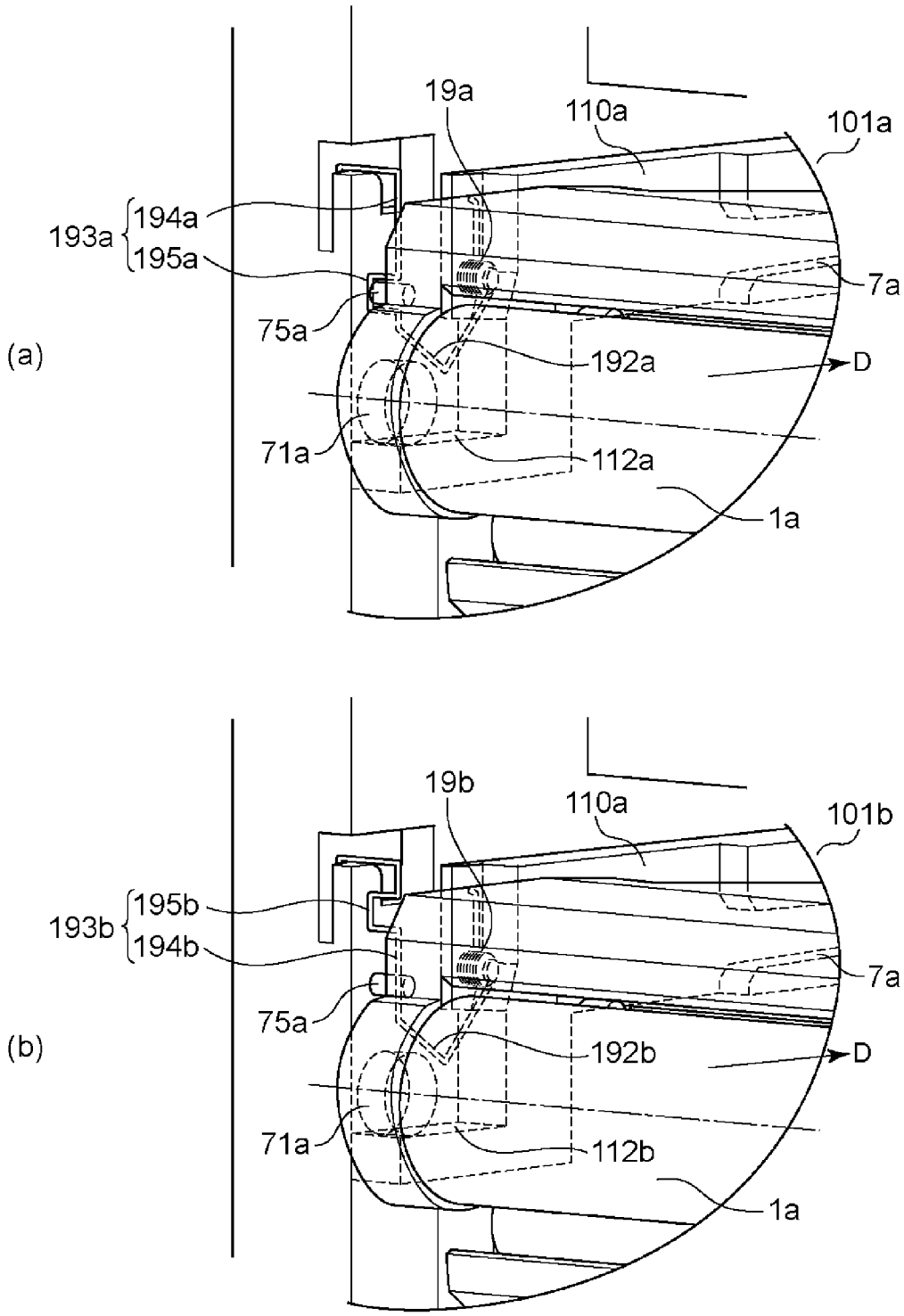
FIG. 10 is a combination of a perspective view of one of the lengthwise ends of one of the process cartridges in the second embodiment, and the corresponding lengthwise end of the corresponding cartridge, and shows the process cartridge installation error preventing means.

Next, referring to FIG. 10(*a*), when the cartridge 7*a* is inserted into the cartridge slot 101*a*, that is, the correct cartridge slot, the cartridge identification projection 75*a* is not hung up by the cartridge blocking portion 194*a*; the U-shaped portion 195*a* allows the cartridge identification projection 75*a* to pass. As the projection 75*a* passes through the U-shaped portion 195*a*, the cartridge positioning projection 71*a* pushes up the torsional coil spring 19*a* by the cartridge contacting portion 192*a* of the coil spring, and the cartridge 7 moves into its image forming position, as in the first embodiment.

Figure 8:
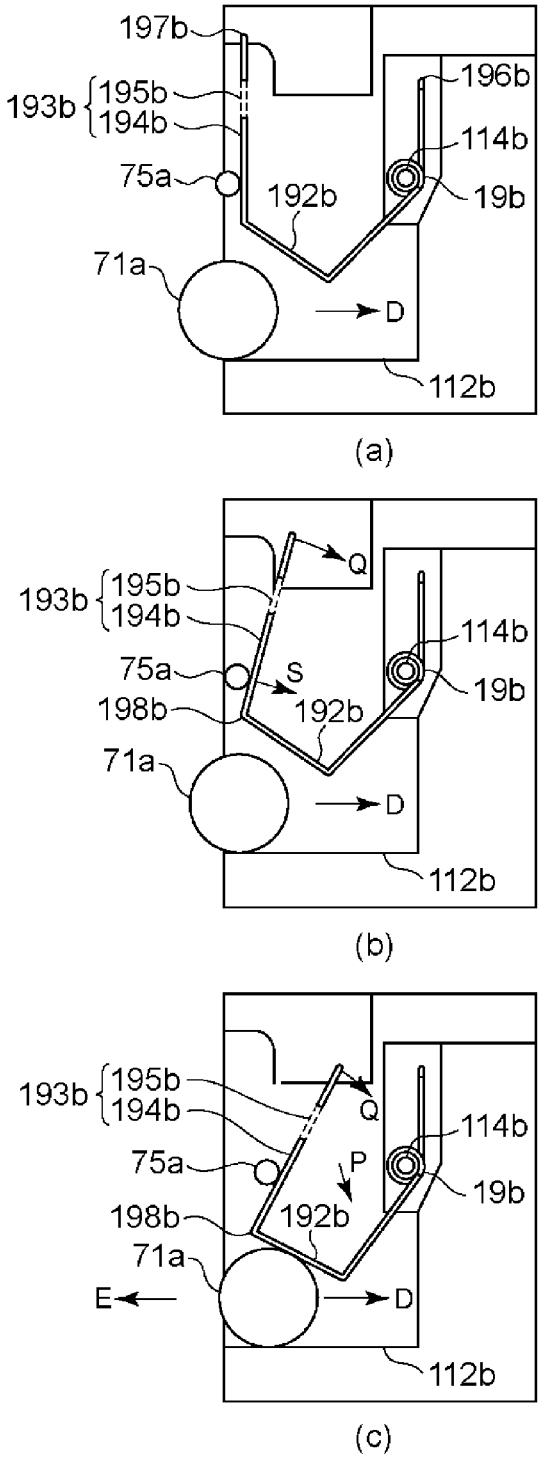
FIG. 8 is a drawing for describing the changes which occur to the positional relationship between the cartridge positioning projection of a cartridge and the cartridge positioning torsional coil spring of the cartridge slot of the image forming apparatus, the changes which occur to the positional relationship between the cartridge identification projection and the cartridge positioning torsional coil spring, and the changes which occur to the shape of the cartridge positioning torsional spring, in the second preferred embodiment of the present invention.

On the other hand, as a user tries to install the cartridge 7*a* into the cartridge slot 101*b*, for example, that is, a wrong one, as shown in FIGS. 10(*b*) and 8(*a*), the identification projection 75*a* comes into contact with the cartridge blocking portion 194*b* before the cartridge positioning projection 71*a* comes into contact with the cartridge blocking portion 194*b*. As the cartridge 7*a* is inserted further into the cartridge slot 101*b*, the cartridge blocking portion 194*b* continues to block the identification projection 75*a*. Consequently, the torsional coil spring 19*b* is elastically bent at its bend between the cartridge screening portion 193*b* and cartridge contacting portion 19*b* (by which coil spring 19*b* is pushed upward) in such a manner that the semi-free end portion 197*b* moves in the direction indicated by an arrow mark Q. Then, as the cartridge 7*a* is inserted further, the torsional coil spring 19*b* is further bent at its bend 192*b* in the direction of the arrow mark Q, and the cartridge screening portion 193*b* is tilted in the direction indicated by the arrow mark S. Consequently, the torsional coil spring 19*b* is torqued in such a direction (indicated by arrow mark P) that the portion 192*b* (by which spring 19*b* is pushed upward) comes into contact with the projection 71*a* and presses the projection 71*a* toward the cartridge positioning surface 112*b*, as shown in FIG. 8(*c*). At this point in the cartridge insertion, it becomes impossible for the torsional coil spring 19*b* to deform and/or to be further torqued, and therefore, the cartridge 7*a* is prevented from being inserted further. If the user releases the cartridge 7*a* at this point, the torsional coil spring 19*b*, which is in the state in which it is elastically deformed in the direction indicated by the arrow mark Q, generates such a force that the portion 194*b* pushes back the identification projection 75*a* toward the entrance of the cartridge slot 101*b* (indicated by arrow mark E). Thus, the cartridge 7*a* moves in the direction of the arrow mark E.

Since the cartridges 7*a*-7*d* are made different in the shape and position of their identification portion 72 and projection 71 according to the color of the toner they contain, they can be installed only in the cartridge slots 101*a*-101*d*, respectively. Therefore, regardless of which of the cartridges 7*a*-7*d* is inserted into a wrong cartridge slot 101, or in which of the cartridge slots 101*a*-101*d* a wrong cartridge 7 is inserted, the same effects as those described above can be obtained.

In this embodiment, the torsional coil spring 19 plays two roles. That is, in a case where a given cartridge 7, which is being inserted into a given cartridge slot 101, is a correct one for the cartridge slot 101, the torsional spring 19 plays the role of pressure applying means for properly positioning the cartridge 7 relative to the main assembly of the image forming apparatus 100, for image formation, whereas in a case where the cartridge 7 is not the correct one for the cartridge slot 101, the torsional spring 19 plays the role of pressure applying means for pressing the cartridge 7 toward the entrance of the cartridge slot 101.

Further, in this embodiment, even when a cartridge 7, which is being inserted in a given cartridge slot 101, is a wrong one for the cartridge slot 101, the cartridge 7 can be inserted into the cartridge slot 101 almost all the way. Therefore, it is unlikely for the cartridge 7 to be subjected to an excessive amount of force by a user (installer). In the first embodiment, if a cartridge 7, which is being inserted into a given cartridge slot 101, happens to be a wrong one for the cartridge slot 101, the cartridge 7 has to be inserted against the cartridge screening-pressing means (compression spring 17) which is greater in the amount of resiliency than the positioning-pressing means (torsional coil spring 15). In comparison, in this embodiment, in a case where a cartridge 7 is inserted into a wrong cartridge slot 101 and is pushed back toward the entrance of the cartridge slot 101, it is not necessary for the cartridge screening-pressure applying means to press the cartridge 7 against the positioning-and-pressure applying means. Therefore, the cartridge screening-pressure applying means in the second embodiment can be set to be lower in the amount of resiliency than the counterpart in the first embodiment. That is, this embodiment is smaller in the amount of the force necessary for a user to apply to a cartridge to install a cartridge 7 into the image forming apparatus 100, and the amount of the load to which the identifying-pressure applying means and adjacent components are subjected when the cartridge 7 is installed. Moreover, in the second embodiment, a single component plays both the role of the positioning-pressure applying means and the role of the cartridge screening-pressure applying means. Therefore, the image forming apparatus in this embodiment is smaller in the component count.

Further, in this embodiment, the torsional coil spring 19 was at the entrance of each cartridge slot 101, and was on the left inward surface of the cartridge slot 101. However, the torsional coil spring 19 may be placed on both the left and right inward surfaces of each cartridge slot 101. Placing the torsional coil spring 19 on both the left and right inward surfaces of each cartridge slot 101 makes it possible for a cartridge 7 to be pushed back from within the cartridge slot 101 in parallel to the main assembly of the image forming apparatus 100. Further, in a case where both the left and right inward surfaces of each cartridge slot 101 is provided with the torsional coil spring 19, the two torsional coil springs 19 may be made different in shape to increase the image forming apparatus 100 in the number of the process cartridges therefor, which can be screened by the apparatus 100.

Referring to FIG. 9, also in this embodiment, each cartridge slot 101 is provided with the cartridge position controlling portion 155 for preventing the problem that a process cartridge 7 accidentally falls out of the main assembly of the image forming apparatus 100, as in the first embodiment. Therefore, it does not occur that when a cartridge 7 inserted into a wrong cartridge slot 101 is pushed back, it falls out of the main assembly of the image forming apparatus.

Embodiment 3

Figure 11:
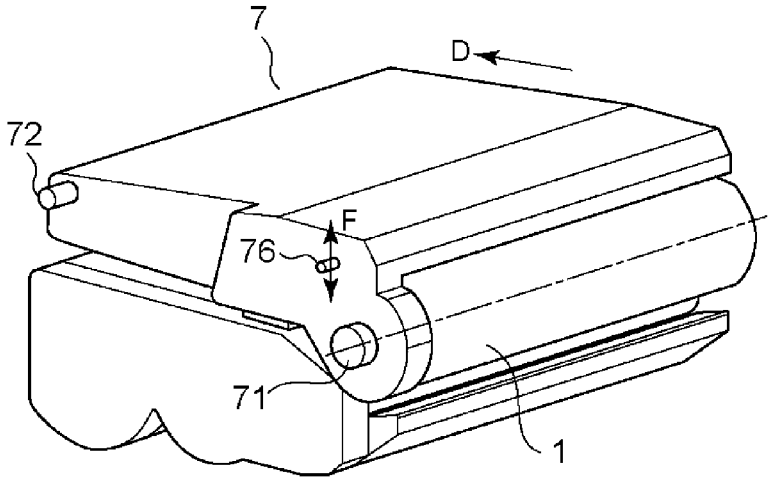
FIG. 11(*a*) is a perspective view of the process cartridge in the third preferred embodiment of the present invention, and shows the general structure of the cartridge.
Figure 11:
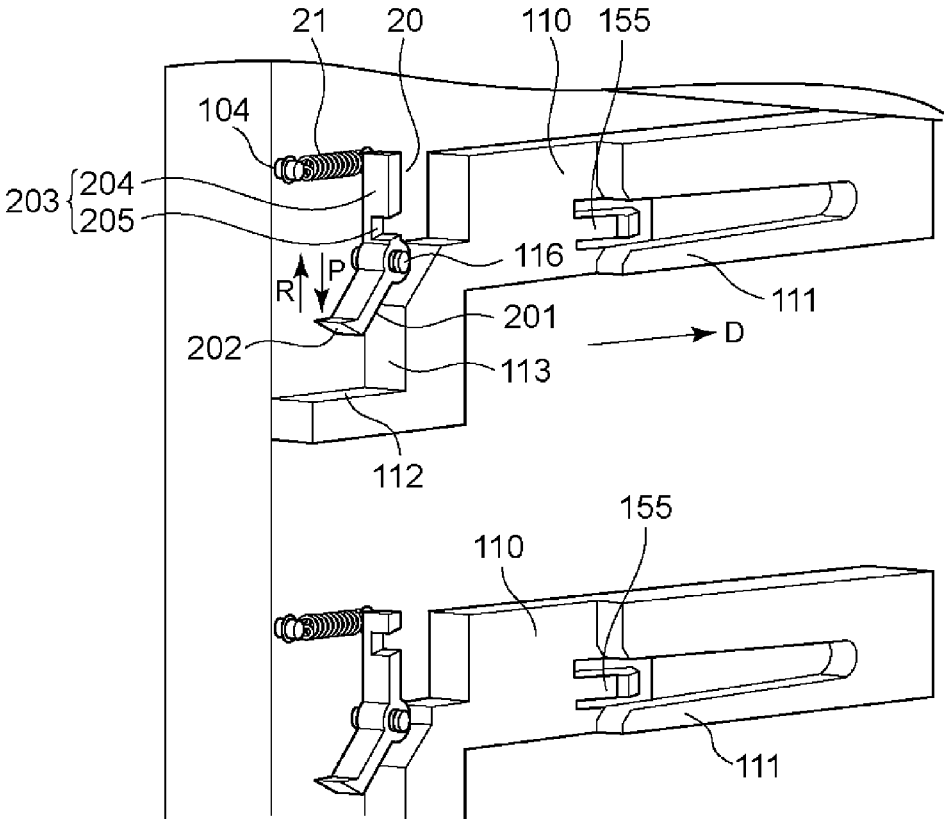

Next, the third preferred embodiment of the present invention is described with reference to the appended drawings. The components, their portions, etc., of the image forming apparatus in this embodiment, which are the same in description as the counterparts in the first embodiment, are given the same referential codes as those given to the counterparts, and are not going to be described here. FIG. 11(*a*) is a perspective view of the process cartridge in this embodiment. FIG. 11(*b*) is a perspective view of the two of the left cartridge guides 110 in this embodiment.

Referring to FIGS. 11(*a*) and 11(*b*), in this embodiment, a cartridge identification projection 76 is provided in place of the cartridge identification recess 73, which is provided in the first embodiment. Further, a combination of a cartridge locking member 20 and a tension spring 21 (cartridge screening means) is provided in place of the torsional coil spring 15 in the first embodiment.

In terms of the direction indicated by an arrow mark D, the identification projection 76 is on the same lateral wall of the cartridge 7 as the one on which the cartridge positioning projection 71 is. It is on the downstream side of the projection 71. The four cartridges 7*a*, 7*b*, 7*c*, and 7*d* are made different in the position of the identification projection 76, in terms of the direction which is indicated by an arrow mark F and is roughly perpendicular to the rotational axis of the photosensitive drum 1 and the direction of the arrow mark D. That is, the position of the identification projection 76 corresponds to the color of the toner in a cartridge 7.

As for the cartridges slot 101, the left guide 110 of each cartridge slot 101 is provided with the cartridge locking member 20, which is supported by a shaft 116 so that it is rotatable about the shaft 116. Each cartridge slot 110 is also provided with the tension spring 21, which is anchored to a spring hanger 104 and one end of the locking member 20, remaining thereby tensioned (stretched). The locking member 20 has a pressure applying portion 201 for properly positioning, and keeping properly positioned, a cartridge 7, and a portion 202 by which the locking member 20 is pushed upward by a cartridge 7. Thus, the aforementioned one end of the locking member 20 is under the tensile force from the tension spring 21 (remaining pulled by spring 21). Therefore, as a cartridge 7 is inserted all the way into a cartridge slot 101, the positioning-pressure applying portion 201 of the locking member 20 presses the projection 71 of the cartridge 7 toward the cartridge positioning surfaces 112 and 113 (as indicated by arrow mark P). As for the portion 202 by which the locking member 20 is pushed upward by a cartridge 7, as a cartridge 7 is inserted into a cartridge slot 101, the positioning projection 71 comes into contact with the portion 202, and pushes the portion 202 against the resiliency of the tension spring 20 so that the locking member 20 rotates in the direction indicated by an arrow mark R.

Further, the locking member 20 is provided with a cartridge screening portion 203, which is the portion between the end of the locking member 20, to which the tension spring 21 is anchored, and the portion of the locking member 20, at which the locking member 20 is supported by the shaft 116. The cartridge screening portion 203 has a cartridge blocking portion 204 and a cartridge screening slot 205. The slot 205 is for allowing the identification projection 76 of only a correct cartridge 7 to pass the cartridge screening portion 203. That is, the cartridge slots 101*a*, 101*b*, 101*c*, and 101*d* are made different in the position of the cartridge screening slot 205 so that the position of the slot 205 corresponds to the color of the toner in each cartridge 7. In other words, when a cartridge 7, which is being inserted into a given cartridge slot 101, is a wrong one for the cartridge slot 101, the identification projection 76 of the cartridge comes into contact with the cartridge blocking portion 204, preventing thereby the cartridge 7 from being inserted further.

Figure 12:
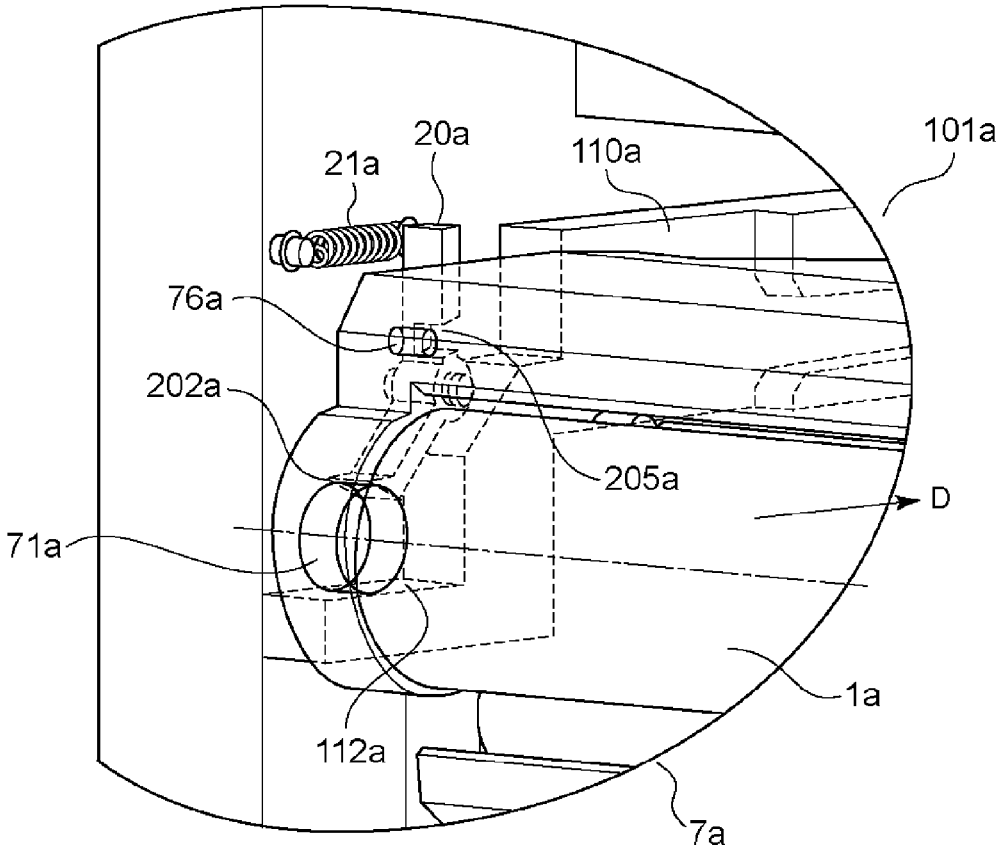
FIG. 12 is a combination of a partial perspective view of one of the lengthwise ends of the process cartridge, and a partially phantom perspective view of the corresponding cartridge slot, and shows how the cartridge is mounted into the cartridge slot.
Figure 13:
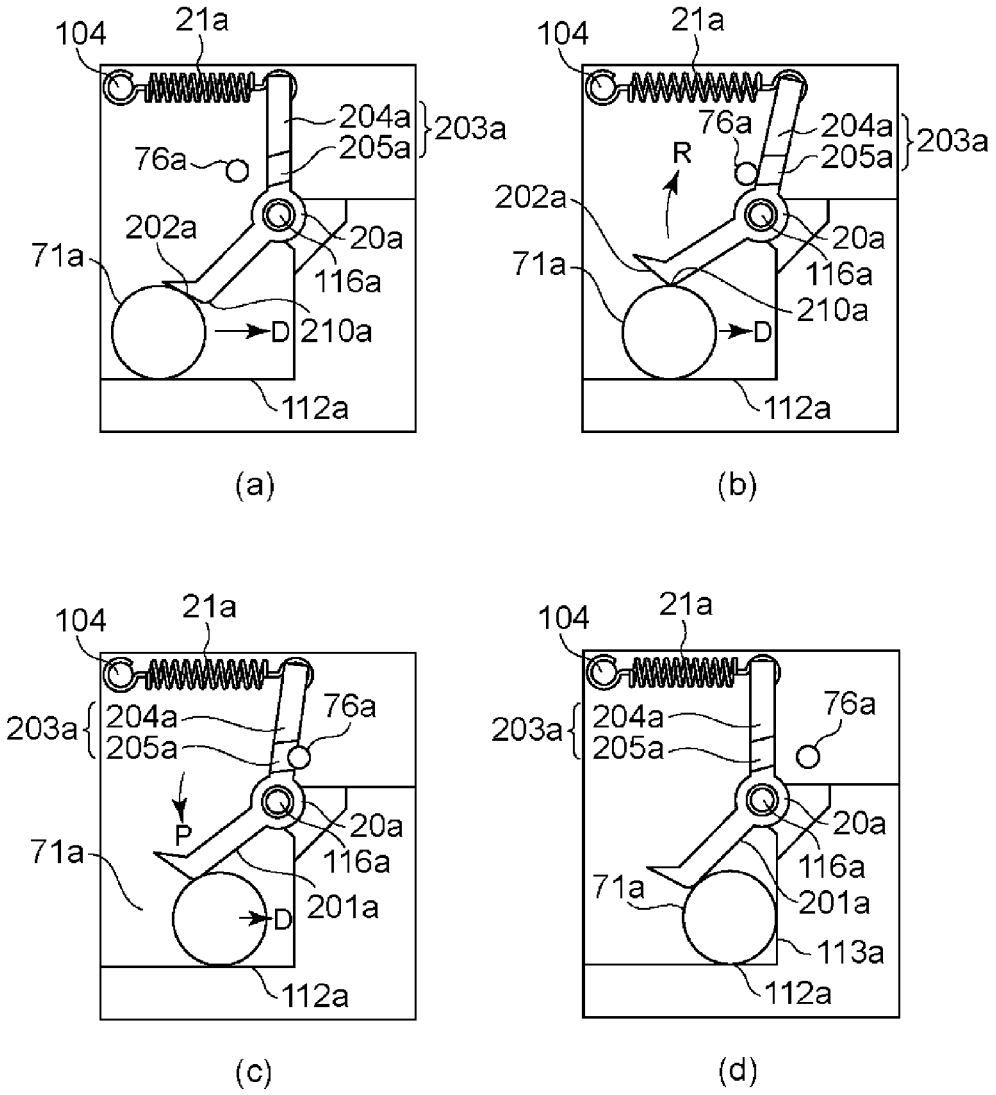
FIG. 13 is a drawing for describing the changes which occur to the positional relationship between the cartridge positioning projection of a cartridge and the cartridge locking member of the cartridge slot of the image forming apparatus, the changes which occur to the positional relationship between the cartridge identification projection and the cartridge locking member, and the changes which occur to the state of the tension spring for the cartridge locking member, when the cartridge is installed in a correct cartridge slot, in the third preferred embodiment of the present invention.

Next, referring to FIGS. 12 and 13(*a*), when the cartridge 7*a* is inserted into the cartridge slot 101*a*, that is, the correct one, the positioning projection 71*a* comes into contact with the portion 202*a* (by which locking member 20 is pushed upward by projection 71*a*) of the locking member 20*a*. Then, as the cartridge 7*a* is inserted further, the projection 71*a* causes the locking member 20*a* in the direction indicated by the arrow mark R against the resiliency of the tension spring 21*a*, until the projection 71*a* reaches the point 210*a* of the locking member 20*a*, which is the downstream end of the portion 202*a* (by which locking member 20 is pushed upward by projection 71*a*) of the locking member 20*a*, as shown in FIG. 13(*b*). When the positioning projection 71*a* is at the point 210*a* of the locking member 20*a*, the projection 76*a* and cartridge screening slot 205*a* coincide in position with each other. Therefore, the projection 76*a* is allowed to move through the slot 205*a*, and the locking member 20*a* rotates in the direction indicated by an arrow mark P. Further, the projection 71*a* is pressed on the cartridge positioning surfaces 112*a* and 113*a*, as shown in FIGS. 13(*c*) and 13(*d*).

Figure 14:
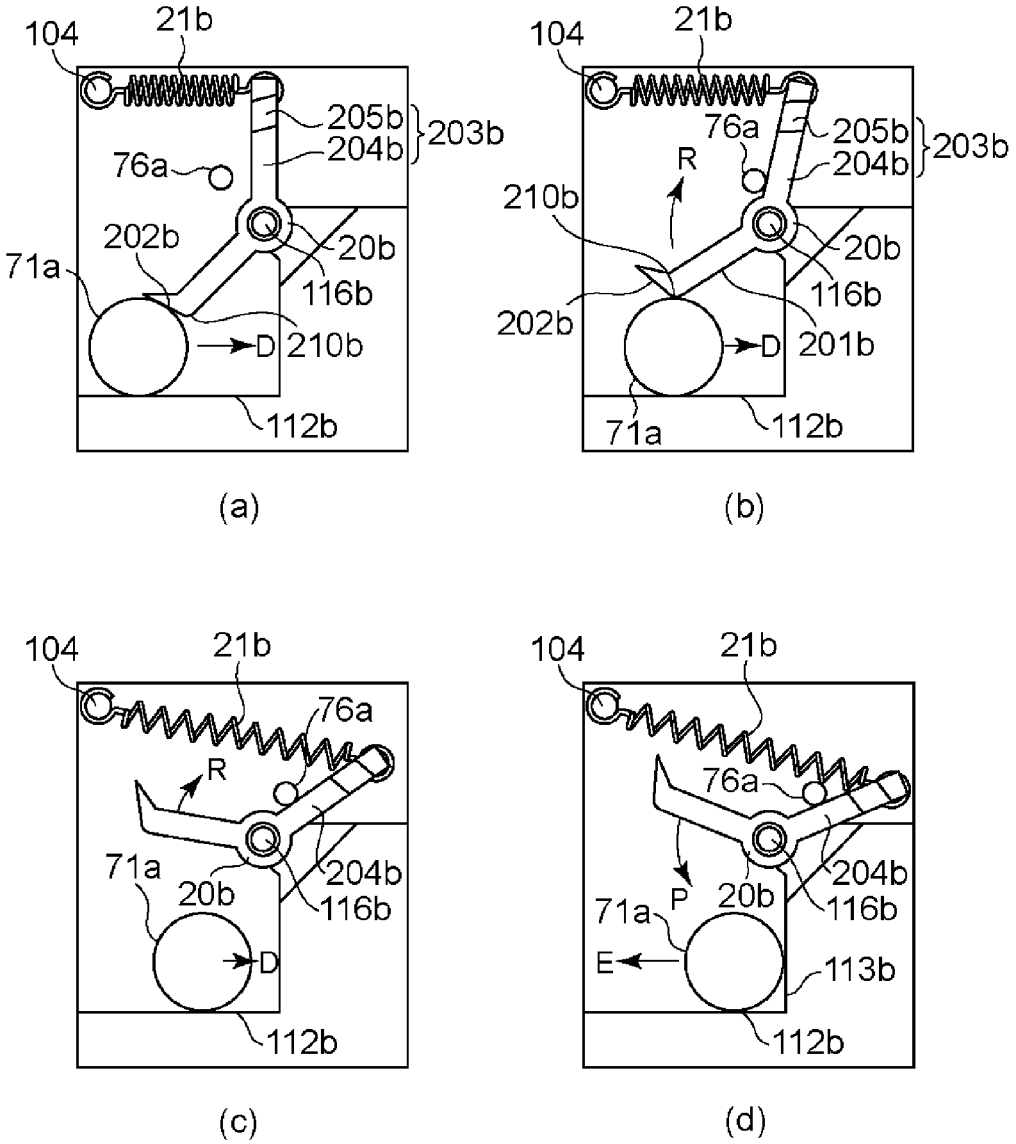
FIG. 14 is a drawing for describing the changes which occur to the positional relationship between the cartridge positioning projection of a cartridge and the cartridge locking member of the cartridge slot of the image forming apparatus, the changes which occur to the positional relationship between the cartridge identification projection and the cartridge locking member, and the changes which occur to the state of the tension spring for the cartridge locking member, when the cartridge is installed in a wrong cartridge slot, in the third preferred embodiment of the present invention.

On the other hand, if the cartridge 7*a* is inserted into the cartridge slot 101*b*, that is, a wrong slot, the cartridge 7 is allowed to enter the slot 101*b* until the positioning projection 71*a* reaches as far as the point 210*b* of the locking member 20 as shown in FIGS. 14(*a*) and 14(*b*). In this case, however, the positioning projection 76*a* does not coincides in position with the cartridge screening slot 205*b* of the cartridge screening portion 203*b* of the locking member 20*b*. Therefore, if the cartridge 7*a* is inserted further, the identification projection 76*a* causes the locking member 20*b* to rotate further in the direction of the arrow mark R, as shown in FIG. 14(*c*). Eventually, the projection 71*a* comes into contact with the cartridge positioning surface 113*b*, as shown in FIG. 14(*d*). That is, the cartridge 7*a* is inserted all the way into the cartridge slot 101*b* and is placed in the image forming position of the cartridge 7*b*. Then, as the user (installer) releases the cartridge 7*a*, the locking member 20*b* is rotated in the direction indicated by the arrow mark P in FIG. 14(*d*) by the resiliency of the tension spring 21. Thus, the identification projection 76*a* is pushed by the locking member 20*b* in the direction indicated by the arrow mark E. Therefore, the cartridge 7*a* is pushed back in the direction of the arrow mark E. While the cartridge 7*a* is pushed back, the identification projection 76*a* remains in contact with the cartridge blocking portion 204*b* of the locking member 20 until the positioning projection 71*a* moves past the point 210*b* of the locking member 20*b*. Therefore, the locking member 20 does not interfere with the movement of the positioning projection 71*a* in the direction of the arrow mark E. In other words, if a given cartridge 7 is inserted all the way into a wrong cartridge slot 101, the cartridge 7 is pushed back at least to where the cartridge 7*a* is in FIG. 14(*a*).

The cartridges 7*a*-7*d* are made different in the position of the identification projection 76 so that the position of the identification projection 76 corresponds to the color of the toner in a cartridge 7. Further, the cartridges slots 101*a*-101*d* also are made different in the position of the cartridge screening slot 205 of the cartridge screening portion 203 of the locking member 20 so that the position of the cartridge screening slot 205 corresponds to the color of the toner in the correct cartridge 7 for the cartridge slot 101. Therefore, the cartridges 7*a*-7*d* can be installed only in the cartridge slots 101*a*-101*d*, respectively. Incidentally, what occurs if the cartridge 7*b*, 7*c*, or 7*d* is inserted into a wrong cartridge slot 101 is similar to what occurs as the cartridge 7*a* is inserted into the cartridge slot 101*b*, as described above.

In this embodiment, the tension spring 21 plays two roles, that is, the role of the means for pressing a cartridge 7 for properly positioning the cartridge 7 relative to a cartridge slot 101 when the cartridge 7 is a correct one for the cartridge slot 101, and the role of the means for screening a process cartridge 7 and pressing the cartridge 7 toward the entrance of the cartridge slot 101 when the cartridge 7 is a wrong one for the cartridge slot 101.

Also in this embodiment, a cartridge 7 can be inserted all the way into a cartridge slot 101 even if the cartridge 7 is a wrong one for the cartridge slot 101, as in the first embodiment. Further, the amount of the pressure applied to the means for screening and pressing a cartridge 7 is as small as that in the second embodiment. Therefore, the image forming apparatus 100 in this embodiment is unlikely to suffer from the problem that when a cartridge which a user tries to install into a cartridge slot of the apparatus 100 is a wrong one for the cartridge slot, the user applies an excessive amount of force to the cartridge. Further, the cartridge installation error preventing means of the apparatus 100 is significantly smaller than any conventional cartridge installation error preventing means, in the amount of the load it adds to the amount of the force to be applied to a cartridge by a user when the cartridge needs to be installed into the apparatus 100.

Also in the third embodiment, each cartridge slot is provided with the cartridge position controlling portion 155 for preventing a cartridge 7 from falling out of the main assembly of the image forming apparatus 100. Therefore, it does not occur that when a cartridge 7 is inserted into a wrong cartridge slot 101, it falls out of the main assembly of the apparatus 100 as it is pushed back toward the entrance of the cartridge slot 101.

As is evident from the description of the first to third preferred embodiments of the present invention, not only can the present invention make it easier for a user of an image forming apparatus to recognize that a cartridge is inserted into a wrong cartridge slot of the image forming apparatus, or a cartridge which is being inserted into a cartridge slot of the image forming apparatus is a wrong one, but also, can prevent the problem that when a cartridge is inserted into a wrong cartridge slot, or a cartridge which is being inserted into a cartridge slot is a wrong one for the cartridge slot, the main assembly of the image forming apparatus and/or the cartridge is deformed or damaged. Further, the application of the present invention to an image forming apparatus does not require the apparatus to be increased in size.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 232848/2010 and 131401/2011 filed Oct. 15, 2010 and Jun. 13, 2011, respectively, which are hereby incorporated by reference.

What is claimed is:

1. An image forming apparatus, to which a plurality of cartridges are detachably mountable, the cartridges each having a cartridge side identification portion, said image forming apparatus comprising:

an image forming unit configured to form an image;

a plurality of mounting portions to which the cartridges are demountably mountable; and identification urging means, provided in each of said mounting portions and contacting the cartridge side identification portion, for permitting a cartridge to be mounted to said mounting portion at a mount position when the cartridge is to be properly mounted to said mounting portion on the basis of correspondence with the cartridge side identification portion, and for urging the cartridge in a direction opposite a direction in which the cartridge is mounted when the cartridge is improper for said mounting portion, wherein said identification urging means permits, even when the cartridge is improper for said mounting portion, the cartridge to enter to the mount position where the proper cartridge is mounted.

2. The image forming apparatus according to claim 1, wherein said identification urging means each including a mounting portion side identification portion corresponding to one of the cartridge side identification portions, and when the cartridge is properly mounted to said mounting portion, said mounting portion side identification portion does not interfere with the cartridge side identification portion, and when the cartridge is improper for said mounting portion, said mounting portion side identification portion abuts to the cartridge side identification portion to urge the cartridge in the opposite direction.

3. The image forming apparatus according to claim 2, wherein said mounting portion side identification portion includes a passing portion for passing only the cartridge side identification portion of the proper cartridge, and an abutting portion for abutting to the cartridge side identification portion or the improper cartridge.

4. The image forming apparatus according to claim 1, wherein said mounting portion includes positioning urging means for urging the cartridge to said mounting position, wherein said positioning urging means urges the cartridge to the mounting position only when the cartridge is proper.

5. The image forming apparatus according to claim 4, wherein said positioning urging means and said identification urging means are integral with each other.

6. An image forming to which a plurality of cartridges are detachably mountable, the cartridges each having a cartridge side identification portion, said image forming apparatus comprising:

an image forming unit configured to form an image;

a plurality of mounting portions to which the cartridges are demountably mountable; and identification urging means, provided in each of said mounting portions, for permitting a cartridge to be mounted to said mounting portion when the cartridge is to be properly mounted to said mounting portion on the basis of correspondence with the cartridge side identification portion, and for urging the cartridge in a direction opposite a direction in which the cartridge is mounted when the cartridge is improper for said mounting portion, wherein said mounting portion includes positioning urging means for urging the cartridge to said mounting position by a force which is weaker than a force by which an improper cartridge is urged in the direction opposite the direction in which the cartridge is mounted, and is stronger than a force by which a proper cartridge is urged by said identification urging means.

7. An image forming apparatus to which a plurality of cartridges are detachably mountable, the cartridges each having a cartridge side identification portion, said image forming apparatus comprising:

a plurality of mounting portions to which the cartridges are demountably mountable;

identification urging means, provided in each of said mounting portions and contacting the cartridge side identification portion, for permitting a cartridge to be mounted to said mounting portion when the cartridge is to be properly mounted to said mounting portion on the basis of correspondence with the cartridge side identification portion, and for urging the cartridge in a direction opposite a direction in which the cartridge is mounted when the cartridge is improper for said mounting portion; and a dislodging prevention portion for preventing the improper cartridge urged in the direction opposite a direction in which the cartridge is mounted from being dislodged from the mounting portion.

8. The image forming apparatus according to claim 7, wherein when said process cartridge which is retained by said dislodging prevention portion is demounted from the main assembly, said dislodging prevention portion elastically deforms to permit said improper process cartridge to be demounted.

* * * * *